US010619900B2

(12) United States Patent
Sibik

(10) Patent No.: US 10,619,900 B2
(45) Date of Patent: Apr. 14, 2020

(54) ACCUMULATOR FOR CHARGE MANAGEMENT

(71) Applicant: TRANE INTERNATIONAL INC., Davidson, NC (US)

(72) Inventor: Lee L. Sibik, Onalaska, WI (US)

(73) Assignee: TRANE INTERNATIONAL INC., Davidson, NC (US)

( * ) Notice: Subject to any disclaimer, the term of this patent is extended or adjusted under 35 U.S.C. 154(b) by 133 days.

(21) Appl. No.: 15/644,211

(22) Filed: Jul. 7, 2017

(65) Prior Publication Data

US 2018/0010833 A1 Jan. 11, 2018

Related U.S. Application Data

(60) Provisional application No. 62/359,490, filed on Jul. 7, 2016.

(51) Int. Cl.

| | |
|---|---|
| ***F25B 45/00*** | (2006.01) |
| ***F25D 1/00*** | (2006.01) |
| ***F25B 49/00*** | (2006.01) |
| ***F25B 41/00*** | (2006.01) |
| ***F25B 49/02*** | (2006.01) |

(52) U.S. Cl.

CPC ..... *F25B 45/00* (2013.01); *F25B 41/00* (2013.01); *F25B 49/005* (2013.01); *F25B 49/02* (2013.01); *F25D 1/00* (2013.01); *F25B 2345/002* (2013.01); *F25B 2345/003* (2013.01); *F25B 2600/05* (2013.01); *F25B 2600/2513* (2013.01); *F25B 2700/04* (2013.01)

(58) Field of Classification Search

CPC ..... F25B 2345/002; F25B 2345/003; F25B 2600/05; F25B 2600/2513; F25B 2700/04; F25B 41/00; F25B 45/00; F25B 49/005; F25B 49/02; F25D 1/00

USPC ..... 62/174, 103

See application file for complete search history.

(56) References Cited

U.S. PATENT DOCUMENTS 9,523,523 B2 * 12/2016 Sibik ..... F25B 49/02
2014/0102665 A1 * 4/2014 Sibik ..... F25B 49/02 165/11.1

FOREIGN PATENT DOCUMENTS

JP 04316962 A * 11/1992

* cited by examiner

*Primary Examiner* — Edward F Landrum
*Assistant Examiner* — Chang H Park
(74) *Attorney, Agent, or Firm* — Hamre, Schumann, Mueller & Larson, P.C.

(57) ABSTRACT

Embodiments of an accumulator for charge management are described. A fluid compression system, comprising an accumulator fluidly connected to an evaporator via a spillover port. The spillover port directs working fluid received from the evaporator to be collected and stored in the accumulator, where the stored working fluid is stored and released from the accumulator in response to an operating condition of the evaporator.

18 Claims, 6 Drawing Sheets

ACCUMULATOR FOR CHARGE MANAGEMENT

FIELD

The disclosure herein relates to a fluid compression system, and may be implemented in a chiller unit as part of an HVACR system, and more particularly, to an accumulator for charge management in a fluid compression system. Generally, methods, systems, and apparatuses are described that are directed to charge management (e.g., refrigerant, coolant, etc.) in an evaporator, such as may be used in a fluid compression system.

BACKGROUND

A fluid compression system (e.g., a chiller unit as part of an HVACR system), typically includes a compressor, a condenser, an evaporator and an expansion device forming a refrigeration circuit. The evaporator may be a flooded or falling-film evaporator, which often has a construction of a tube bundle within a shell. Such evaporators are typically used in fluid compression systems to cool a process fluid (e.g., water) flowing in the tube bundle which, in turn, is typically used in connection with a heat exchanger coil or air-handling unit to cool air moving through the coil or air-handling unit. The tube bundle is often stacked up from a bottom of the evaporator. In a flooded evaporator, the tube bundle is covered with working fluid, such as refrigerant, in the shell to help maximize heat exchange between the refrigerant and the process fluid.

The compressor of the fluid compression system often requires lubricant, such as oil, to lubricate moving parts of the compressor. In the fluid compression system, the lubricant may circulate in the refrigeration circuit along with the refrigerant, and then return to the compressor.

SUMMARY

The disclosure herein relates to a fluid compression system, such as may be implemented in e.g., a chiller unit as part of an HVACR system, and more particularly to an accumulator for charge management in the fluid compression system.

Improving fluid management in a fluid compression system can help increase efficiency of the fluid compression system. The fluid management as described herein generally includes managing a charge (e.g., working fluid, refrigerant, coolant, water, lubricant, etc.) in the fluid compression system by incorporating an accumulator (e.g., a reservoir, spill over storage tank). The accumulator can manage the charge such that the fluid compression system may have increased efficiency and/or operate over a broader range of operating conditions and/or charge levels.

Embodiments disclosed herein may use an accumulator fluidly connected to an evaporator to aid in charge management of a fluid compression system, such as a chiller unit as part of an HVACR system. The accumulator can help improve charge management in the fluid compression system by storing and/or providing a desired level of working fluid to the fluid compression system.

In an embodiment, a fluid compression system may comprise an accumulator fluidly connected to an evaporator via a spillover port. The spillover port directs working fluid received from the evaporator to be collected and stored in the accumulator, where the working fluid is stored and released from the accumulator in response to an operating condition of the evaporator. Operating conditions are relative to a charge level of the evaporator. In an embodiment, the working fluid can be released from the accumulator to a first conduit and provided to the fluid compression system.

In an embodiment, an indicator is located at least partially within the accumulator. The indicator can be a level sensor, a site glass, an optical sensor, or the like. The indicator detects a working fluid level (e.g., a level of refrigerant, working fluid, etc.) stored within the accumulator. The detected working fluid level corresponds to a particular operating condition of the evaporator.

In an embodiment, the indicator can be configured to provide an indication of a loss of charge (e.g., working fluid level loss) to a controller of the fluid compression system based on the detected working fluid level. Additionally, or alternatively, in some embodiments, the indicator can detect a transition condition. A transition condition is a detected working fluid level in the accumulator correlating to a loss of working fluid in the evaporator for less than a threshold time and prevents a false alarm.

In an embodiment, the accumulator in some systems can store approximately 1 to 2 cubic feet (e.g., approximately 10 gallons) of working fluid. In an embodiment, a substantial amount or all of the charge from the evaporator can be stored in the accumulator to prevent freezing of the evaporator during a shut-down operation, as discussed further herein. For example, the accumulator can store a portion (e.g., less than 10 gallons) of the working fluid or all (e.g., approximately 10 gallons) of the working fluid 38.

In an embodiment, a fill and drain valve can be connected to the accumulator to drain the stored working fluid from the accumulator back to the evaporator until a mass flow rate of charge is established in the fluid compression system. For example, the working fluid stored in the accumulator can be provided to the evaporator until a charge spillover rate is established. Additionally, or alternatively, actuation of the fill and drain valve is dependent upon a detected loss of working fluid above a threshold time that corresponds to a loss of working fluid in the evaporator in the fluid compression system, as discussed further herein.

In an embodiment, an expansion device is located between the fill and drain valve and the evaporator. The expansion device restricts a flow of charge from a second conduit to the evaporator.

An accumulator to manage charge in a fluid compression system can be advantageous for chiller performance. Charge stored in the accumulator can enable the chiller to operate at an increased efficiency, and/or operate over a broad range of operating conditions and/or charge levels. For example, minor charge loss in the fluid compression system may have little to no effect on an operating efficiency of the chiller. Additionally, or alternatively, the accumulator may be a device that can help a manufacturing/repair factory/user correctly charge the chiller. The accumulator fluidly connected to the evaporator can enable a fluid compression system to be more robust to charge variations by improving tolerance to overcharge and/or undercharge.

Other features and aspects of charge management approaches will become apparent by consideration of the following detailed description and accompanying drawings.

BRIEF DESCRIPTION OF THE DRAWINGS

Reference is now made to the drawings in which like reference numbers represent corresponding parts throughout.

DETAILED DESCRIPTION

In a fluid compression system, such as a chiller unit as part of an HVACR system, fluid management may involve management of charge, such as refrigerant, coolant, water, etc., in a cooling circuit that is typically formed by a compressor, a condenser, an evaporator and an expansion device. The fluid compression system may incorporate methods and systems to manage charge.

In a chiller unit as part of an HVACR system, for example, a broad range of operating conditions (e.g. full and partial loads) and/or charge levels can affect a chiller performance. Proper charge (e.g., working fluid, refrigerant, etc.) in a chiller is important for optimal performance and/or energy efficiency. For example, when charge enters the compressor the chiller performance is reduced, power consumption is increased, and/or damage to the system may occur. Alternatively, an insufficient charge in a chiller may cause heat exchange tubes of the evaporator to be exposed, leading to evaporator dry out. Additionally, water temperature stratification may occur, which can affect a water temperature leaving the evaporator and negatively impact partial load efficiency, and may result in a frozen evaporator.

As described herein, an accumulator can provide charge management in a fluid compression system, such as a chiller unit as part of an HVACR system. The fluid compression system can include an accumulator fluidly connected to an evaporator via a spillover port. The spill over port is fluidly connected to the evaporator, and the spillover port directs working fluid received from the evaporator to be collected and stored in the accumulator. The working fluid is stored and released from the accumulator based on a particular operating condition of the evaporator.

The accumulator fluidly connected to the evaporator in the system can be advantageous for chiller performance. Working fluid stored in the accumulator can enable the chiller to operate at an increased efficiency, and/or operate over a broad range of evaporator operating conditions and/or accumulator working fluid levels. For example, a portion of charge loss may have little to no effect on an operating efficiency of the chiller. Additionally, or alternatively, the accumulator may be a device that can help a manufacturing/repair factory/user properly charge the chiller by using information related to a working fluid level of the accumulator and/or operating condition relevant to the evaporator. Additionally, or alternatively, the accumulator may enable a chiller to be more robust to charge variations by improving tolerance to overcharge and/or undercharge due to the storage capability of the accumulator.

Figure 1:
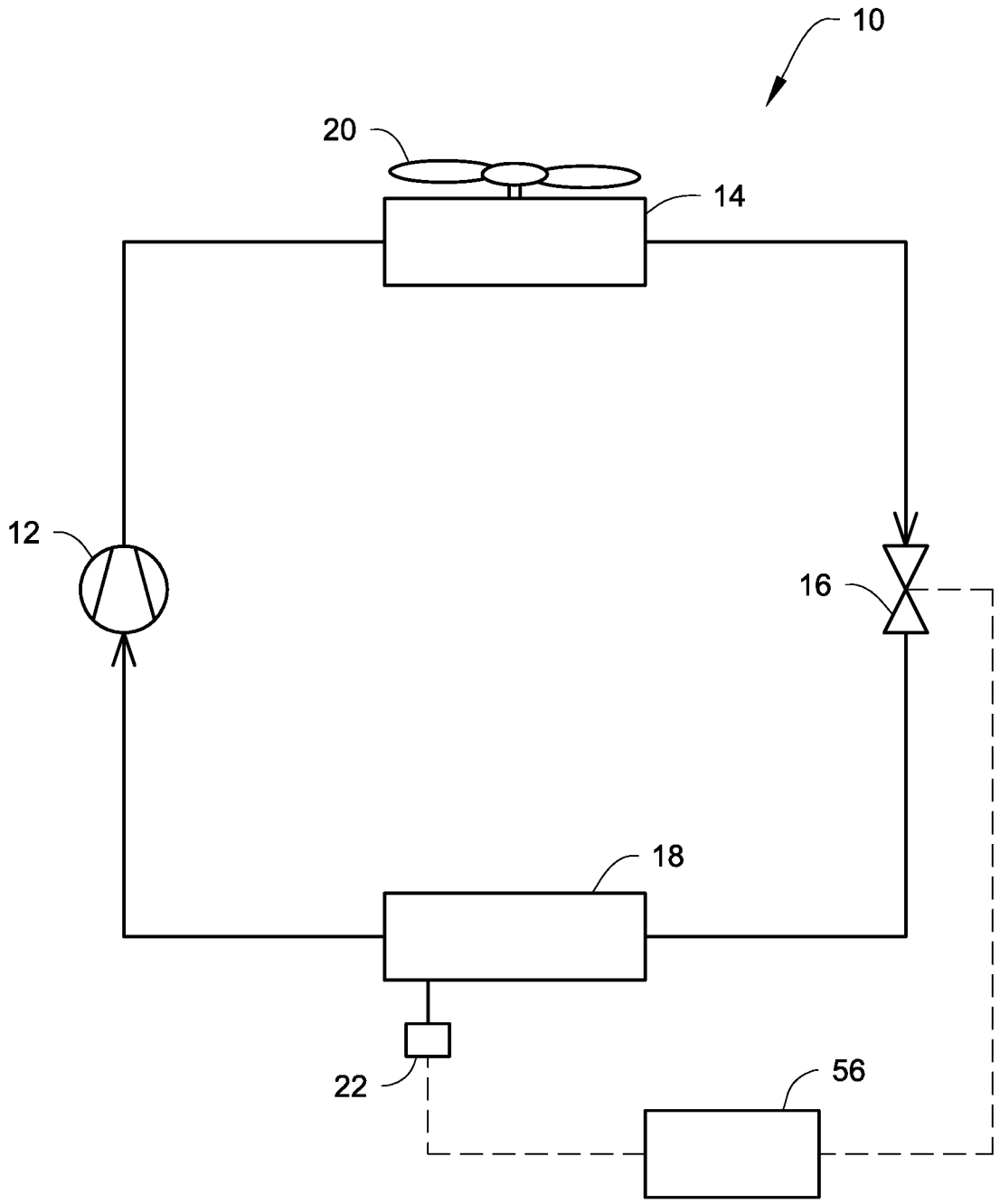
FIG. 1 is a schematic view of a fluid compression system, which includes a compressor, heat exchanger as a condenser, expansion device, an evaporator, and an accumulator according to an embodiment.

FIG. 1 is a schematic view of a fluid compression system 10, which includes a compressor 12, a condenser 14, expansion device 16, an evaporator 18, and an accumulator 22 according to an embodiment. In an embodiment, the fluid compression system 10 can be a fluid chiller unit as part of an HVACR system. The fluid chiller can be an air-cooled fluid chiller and may be charged with refrigerant as a working fluid. In an embodiment, the condenser 14 of the fluid compression system 10 is an air-cooled condenser employing a fan 20. In another embodiment, the condenser 14 can be a water cooled condenser.

The fluid compression system 10 directs the working fluid, such as a refrigerant and lubricant mixture, through the circuit of FIG. 1. It will be appreciated that the working fluid may be fluids other than refrigerant, such as water, coolant, etc., or may be a single component (e.g., a single refrigerant), and/or include various components (e.g., blends) including one or more refrigerants, as well as one or more lubricants, additives, and other fluids. The charge and any of its components can be present in various phases such as for example vapor and/or liquid, depending on where it is in the circuit of the fluid compression system 10, such as for example during a cooling operation. As used herein, charge and working fluid are used interchangeably herein, and charge can be associated with respect to the evaporator.

The compressor 12 compresses the working fluid, and directs the working fluid to the condenser 14. The condenser 14 condenses the working fluid from a vapor to a liquid and directs the working fluid to the expansion device 16. The condenser 14 in some cases can employ a fan 20 which draws a heat exchanger fluid, such as for example air, across the condenser 14 to condense the working fluid. The condenser 14 may include one or more heat exchanger coils which pass the working fluid through the condenser 14. The expansion device 16 expands the working fluid to further cool the working fluid, where the working fluid can become a mixed vapor liquid phase fluid. The working fluid is directed to the evaporator 18, where the working fluid is evaporated into a vapor. The evaporator 18 can include a heat exchanger, such as a tube bundle, that is stacked from a bottom of the evaporator 18. The tube bundle can vaporize the working fluid (e.g., refrigerant, oil, etc.) within the evaporator 18. The working fluid may then return to the compressor 12 and be recirculated through the circuit.

In an embodiment, the fluid compression system 10 includes an accumulator 22 positioned externally to the evaporator 18. The accumulator 22 is fluidly connected to the evaporator 18. The accumulator 22 can serve as a reservoir that collects and stores working fluid from the evaporator 18. The working fluid can include, for example, a mixture of refrigerant and lubricant (e.g., oil). The fluid compression system 10 includes a controller 56 that can be configured to control the expansion device 16 and/or the working fluid flow from the accumulator 22 to the evaporator 18. The controller 56 is comprised of a combination of hardware and software configured to send and receive signals. For example, the controller 56 is configured to receive a working fluid level measured by an indicator, as discussed further herein.

In an embodiment, the condenser 14 includes a heat exchanger coil, which may be a microchannel heat exchanger coil (microchannel coil). A microchannel coil in some instances has flattened tubes that extend from one or more headers. A microchannel coil may have one or more rows of flattened tubes, be folded on itself, and may use the same header or have different headers connected to the ends of the flattened tubes. A microchannel coil has multiple channels within each of the flattened tubes and fins between the flattened tubes. As the capacity of the condenser 14 is reduced, the accumulator 22 fluidly connected to the evaporator 18 can store the charge during various states of operating conditions of the fluid compression system, such as at various loads, at shut-down, which are further discussed herein.

Figure 2:
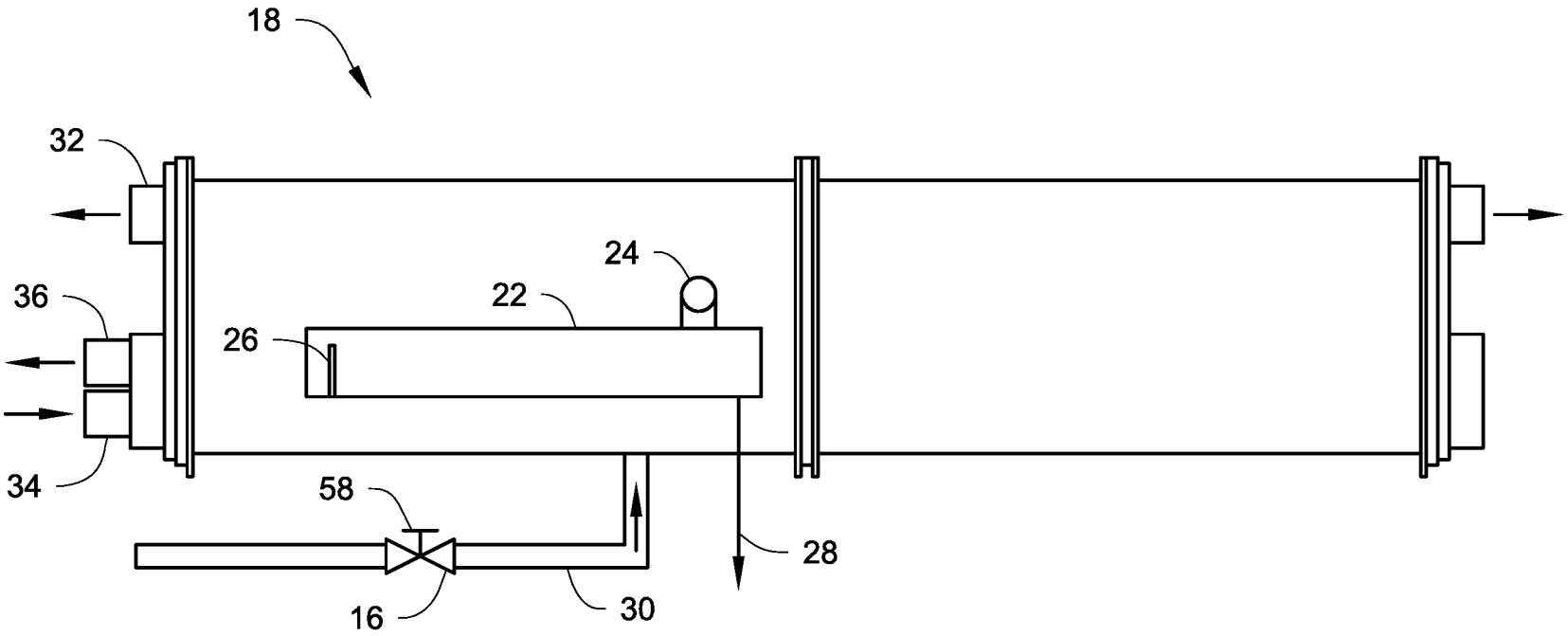
FIG. 2 illustrates an accumulator fluidly connected to an evaporator in a fluid compression system according to an embodiment.

FIG. 2 illustrates an evaporator 18 with a spillover port 24 fluidly connecting an accumulator 22 in a fluid compression system. The accumulator 22 can act as a storage tank for an evaporator 18 in the fluid compression system. The accumulator 22 can be positioned externally to the evaporator 18.

As illustrated in FIG. 2, the spillover port 24 fluidly connects the evaporator 18 and the accumulator 22. The spillover port 24 directs working fluid (e.g., refrigerant, refrigerant/lubricant mixture, etc.) received from the evaporator 18 to be collected and stored in the accumulator 22. The accumulator 22 further includes a first conduit 28 that serves as a lubricant return line. For example, the working fluid containing lubricant (e.g., oil) can drain from the accumulator 22 and into the first conduit 28. In some instances, oil may eventually collect in the evaporator 18, as discussed further herein.

An indicator 26 can be located at least partially within the accumulator 22. In some embodiments, the indicator 26 can be a level sensor that detects a working fluid level in the accumulator 22. The indicator 26 can detect working fluid level variations within the accumulator 22. The working fluid level variations can include a full load level, a partial load level, and a working fluid loss level, as discussed further herein.

In some embodiments, the working fluid level collected within the accumulator 22 can change passively for example according to system operation (e.g. system pressures), thus eliminating a need for a controller. For example, the accumulator 22 can collect the working fluid from the evaporator 18 through the spillover port 24 via gravity (e.g., passively). Alternatively, in an embodiment, the working fluid may be collected and stored in the accumulator 22 non-passively, such as with use of a pump (not shown).

FIG. 2 further illustrates the evaporator 18 connected to an expansion device 16 and a second conduit 30 connected to the evaporator 18. The expansion device 16 and second conduit 30 can direct working fluid to the evaporator 18. The expansion device 16 includes an expansion valve 58, which can be opened to direct working fluid to the evaporator 18 or closed to prevent working fluid from flowing to the evaporator 18. In an embodiment, a fill and drain valve (not shown) can release working fluid stored in the accumulator 22 to be provided to the evaporator 18 for mass balance reestablishment, as discussed further herein. In an embodiment, the evaporator 18 is a flooded type evaporator.

The evaporator 18 further includes an evaporator outlet 32 for the working fluid to flow to the compressor inlet of a compressor (not shown), a water inlet 34, and a water outlet 36 for water to flow in and out of the evaporator 18.

FIG. 3A-5 illustrate the accumulator in the fluid compression system according to different embodiments. The fluid compression system 10 includes accumulator 22, spill over port 24, evaporator 18, an indicator 26, second conduit 30, expansion device 16, expansion valve 58, compressor 12, and condenser 14, wherein these elements are similar to the like features shown and described with respect to FIGS. 1 and 2. For simplicity, features which are the same and were previously described are not described in additional detail.

The spill over port 24 provides working fluid 38 from the evaporator 18 to the accumulator 22. The working fluid 38 (e.g., refrigerant, lubricant, mixture, etc.) is transferred from the evaporator 18 to the accumulator 22 from a location with a high concentration of lubricant (e.g., oil). The accumulator 22 can store the working fluid 38 until such working fluid 38 is needed in the system, as discussed further herein.

The evaporator 18 can provide a charge spill-over rate to the accumulator 22. The charge spill-over rate is an amount of working fluid 38 provided from the evaporator 18 to the accumulator 22 via the spill over port 24. The charge spill-over rate can be an amount (e.g., a rate of flow over time) of working fluid 38 that varies based on an operating condition 46 associated with the evaporator 18. That is, the charge spill-over rate is an amount of working fluid 38 that is provided from the evaporator 18 to the accumulator 22 over a period of time. In an embodiment, the charge spill-over rate may correlate with changes in operating condition 46 relative to the evaporator 18. Generally, a charge spill-over rate may be less than or approximately 5% of a total compressor flow (e.g. mass flow of the working fluid). The charge spill-over rate may vary between approximately 0% and 5% of the compressor flow. The variation in charge spill-over rate can correlate to variations in operating condition 46. For example, a steady state (e.g., constant) charge spill-over rate may be determined by a drain rate of the accumulator 22. The drain rate is the amount of working fluid (e.g., refrigerant, lubricant, etc.) that flows from the accumulator 22, through the first conduit 28, and to the compressor 12.

As previously mentioned, sufficient charge (e.g., working fluid 38) is important for proper functioning of a fluid compression system 10. As discussed further herein, a working fluid level 44 in the accumulator 22 can correspond to an operating condition 46 relative to the evaporator 18. In an embodiment, the working fluid level 44 that correlates to an operating condition 46 relevant to the evaporator 18 can signify whether charge loss is a threat to proper functioning of the system 10.

In an embodiment, the working fluid level 44 (e.g., an amount of working fluid 38 stored) in the accumulator 22 can correlate with the operating condition 46 of the system 10. Since the charge spill-over rate transfers working fluid 38 from the evaporator 18 to the accumulator 22 via spill over port 24, the working fluid level 44 in the accumulator 22 is dependent upon the particular operating condition 46 relevant to the evaporator 18. That is, the amount of charge in the evaporator 18 affects the working fluid level 44 in the accumulator 22. As such, the working fluid level 44 in the accumulator 22 can be used to indicate a correlating operating condition 46 relevant to the evaporator 18.

In an embodiment, the indicator 26, such as a level sensor, can detect a working fluid level 44 in the accumulator 22. The indicator 26 can be within the accumulator 22 and submerged in the working fluid that accumulates from the spill over port 24. The working fluid level 44 detected by the indicator 26 corresponds to the particular operating condition 46 relevant to the evaporator 18. The working fluid level 44 in the accumulator 22 can change in response to the operating condition 46, which is the amount of working fluid 38 in the evaporator 18. In some circumstances, the working fluid level 44 in the accumulator 22 can change in response to changes in amounts of working fluid 38 associated with other components of the system 10, such as but not limited to the condenser 14, inter connecting piping (not shown), and other components of the fluid circuit which may or may not be shown. In an embodiment, the volume of charge in the evaporator 18 can be at or nearly constant, but the density of the working fluid 38 can change with the operating condition 46. A density of the working fluid 38 can be inversely related to the void fraction of the fluid. The void fraction is the ratio of vapor to liquid in the working fluid 38. The void fraction of the working fluid 38 can change as a direct function of the compressor 12 mass flow 42.

As illustrated in FIGS. 3A-5, the indicator 26 can be a level sensor. The indicator 26 can detect the working fluid level 44 within the accumulator 22 that corresponds to a particular operating condition 46 relative to the evaporator 18. Although the indicator 26 associated with the accumulator 22 in FIGS. 3A-5 is depicted as a level sensor, it will be appreciated that the indicator 26 may be a site glass, optical sensor, visual inspection, and/or the like. For example, in some embodiments a site glass and/or an optical sensor could also be used such that detection of charge loss (e.g., working fluid loss level) is based on a visual inspection using the site glass and/or optical sensor (not shown). For instance, the level sensor 26 can be a site glass that is a transparent window, which allows a view into the accumulator 22. An operator (e.g., a user, etc.) can view into the site glass to see a level of liquid within the vessel (e.g., accumulator 22). In some examples, the indicator 26 can be an optical sensor that may include an infrared LED and a light transistor. The LED can project light through the liquid (e.g., working fluid 38), which bounces back to the transistor. The amount of light returned to the transistor affects the output level. That is, the optical sensor can indicate the working fluid level 44 (e.g., amount of working fluid 38) in the accumulator 22.

The evaporator 18 can have a plurality of operating conditions 46, each of which may indicate an overall functioning of the fluid compression system 10. The plurality of operating conditions 46 relevant to an evaporator 18 can include: a full load operating condition 46-1 (shown in FIG. 3A); a partial load operating condition 46-2 (shown in FIG. 3B); a shut-down operating condition 46-3 (shown in FIG. 5); and a start-up operating condition (not shown). The plurality of operating conditions 46 (e.g., 46-1, 46-2, 46-3) are generally referred to herein as operating condition(s) 46. In some embodiments, additional operating conditions 46 may be relevant to the evaporator 18.

Each of the plurality of operating conditions 46 relative to the evaporator 18 may correspond to a particular working fluid level among a plurality of working fluid levels 44 in the accumulator 22. The plurality of working fluid levels 44 can include a full load working fluid level 44-1 (shown in FIG. 3A); a partial working fluid level 44-2 (shown in FIG. 3B); a working fluid loss level 44-3 (shown in FIG. 4); and a start-up operating working fluid level (not shown). The plurality of working fluid levels 44 (e.g., 44-1, 44-2, 44-3) are generally referred to herein as working fluid level(s) 44.

The plurality of operating conditions 46 relative to the evaporator 18 and the plurality of working fluid levels 44 in the accumulator 22 will be discussed further herein with respect to FIGS. 3A-5.

Figure 3A:
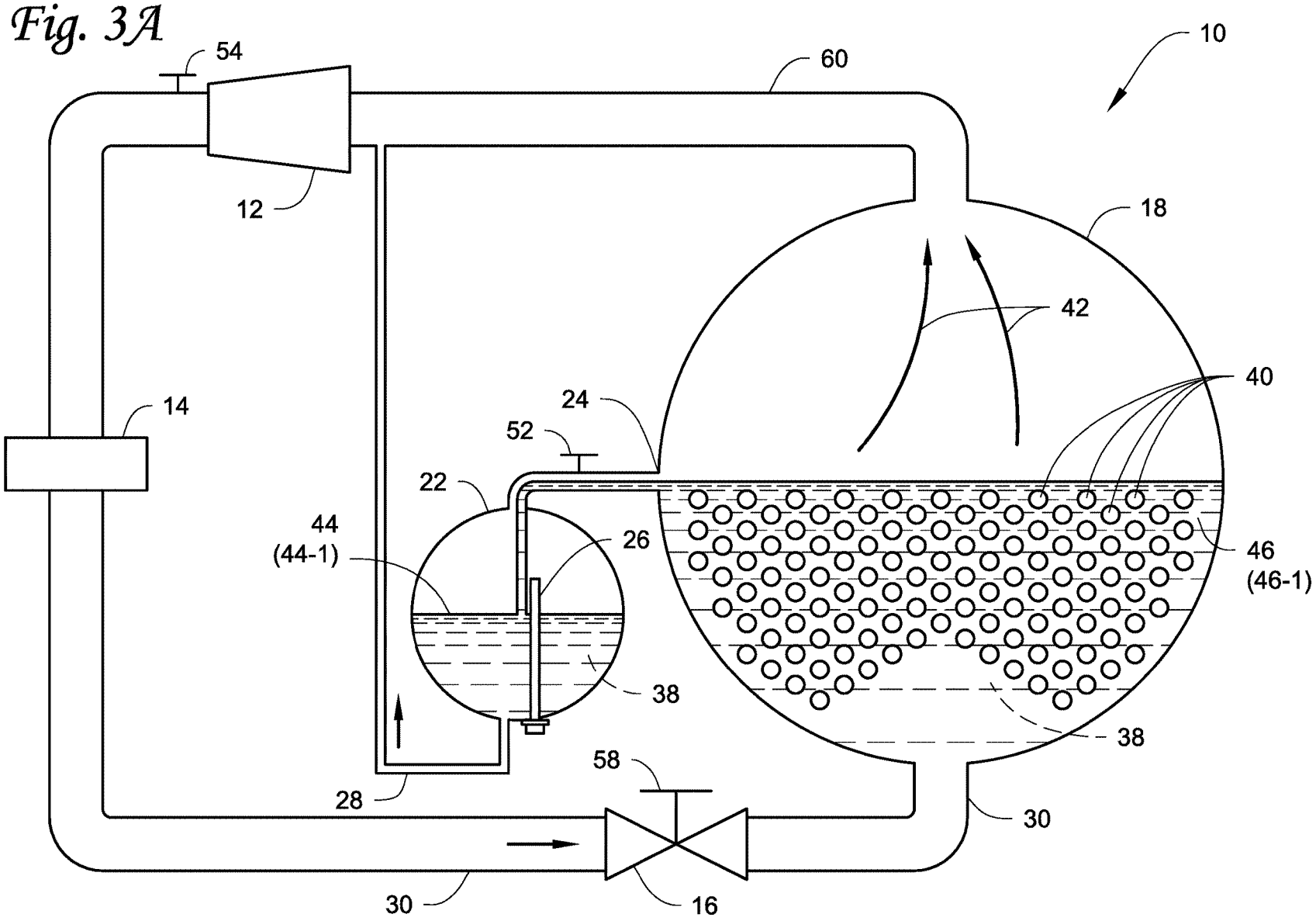
FIG. 3A illustrates the accumulator in the fluid compression system according to a first embodiment.

FIG. 3A illustrates the accumulator in a fluid compression system 10 according to a first embodiment. FIG. 3A illustrates a full load operating condition 46-1 associated with the evaporator 18.

A full load operating condition 46-1 is a fully charged evaporator 18. The tube bundle 40 in the evaporator 18 can be covered (e.g., submerged) in working fluid 38. The evaporator 18 can heat the charge to vapor 42. The vapor 42 (e.g., working fluid 38 in gas state) can travel through a third conduit 60 to the compressor 12. The full load operating condition 46-1 can have an increased void fraction of the working fluid 38 in evaporator 18 compared to a partial load operating condition 46-2, as described further herein with respect to FIG. 3B. The increased void fraction can reduce the mass of working fluid 38 in the evaporator 18. The reduction of charge level in the evaporator 18 is transferred into the accumulator 22, increasing the charge spill-over rate. That is, a fully charged evaporator 18 can increase the charge spill-over rate of working fluid 38 as the void fraction of the working fluid 38 increases.

As the charge spill-over rate increases, a working fluid level 44 in the accumulator 22 can increase. A full load working fluid level 44-1 in the accumulator 22 can correlate to the full load operating condition 46-1 relative to the evaporator 18. That is, an increased (e.g., high) amount of charge spill-over from the evaporator 18 into the accumulator 22 can increase the working fluid level 44 (e.g., amount) stored in the accumulator 22. When the rate of charge density in the evaporator 18 is at or about 0, the charge spill-over rate may decrease to a rate equal to the rate of the fluid leaving the accumulator 22 (e.g., via conduit 28).

The working fluid level 44 in the accumulator 22 can indicate the operating condition 46 relative to the evaporator 18. For example, a high level of working fluid 38 (e.g., full load charge level 44-1) in the accumulator 22 can indicate the full load operating condition 46-1 relative to the evaporator 18. In an embodiment, the increased amount of charge from the evaporator 18 can be stored in the accumulator 22 until the evaporator 18 requires the working fluid 38, such as when operating in a different operating condition 46, as discussed further herein.

For example, working fluid 38 (e.g., refrigerant and lubricant mixture) can be provided from the evaporator 18 to the accumulator 22 via the spill over port 24 when in a full load operating condition 46-1. The working fluid 38 can drain from the accumulator 22 into the first conduit 28 for circulation in the fluid compression system 10. The working fluid 38 drained to the first conduit 28 can be provided to the compressor 12 via compressor suction. From the compressor 12, the working fluid 38 can flow to the condenser 14, through the second conduit 30, and to the expansion device 16. The expansion device 16 includes an expansion valve 58 that can be opened (e.g., unsealed) to allow flow to the evaporator 18 or closed (e.g., sealed) to prevent flow to the evaporator 18. The expansion valve 58 can be opened or closed in response to the operating condition 46 relative to the evaporator 18. When the evaporator 18 is functioning in a full load operating condition 46-1, the expansion valve 58 is open to allow working fluid 38 to flow through the fluid compression system 10.

In some instances, lubricant (e.g., oil) can collect in the evaporator 18 when there is a lack of working fluid 38 (e.g., working fluid loss, loss of refrigerant, etc.) in the evaporator 18, which can cause a problem in the functioning of the fluid compression system 10. When there is working fluid loss, the accumulator 22 may provide working fluid 38 to the system 10 via the first conduit 28 until charge spills over via the spill over port 24 and balance is reestablished in the fluid compression system 10, as discussed further herein.

Figure 3B:
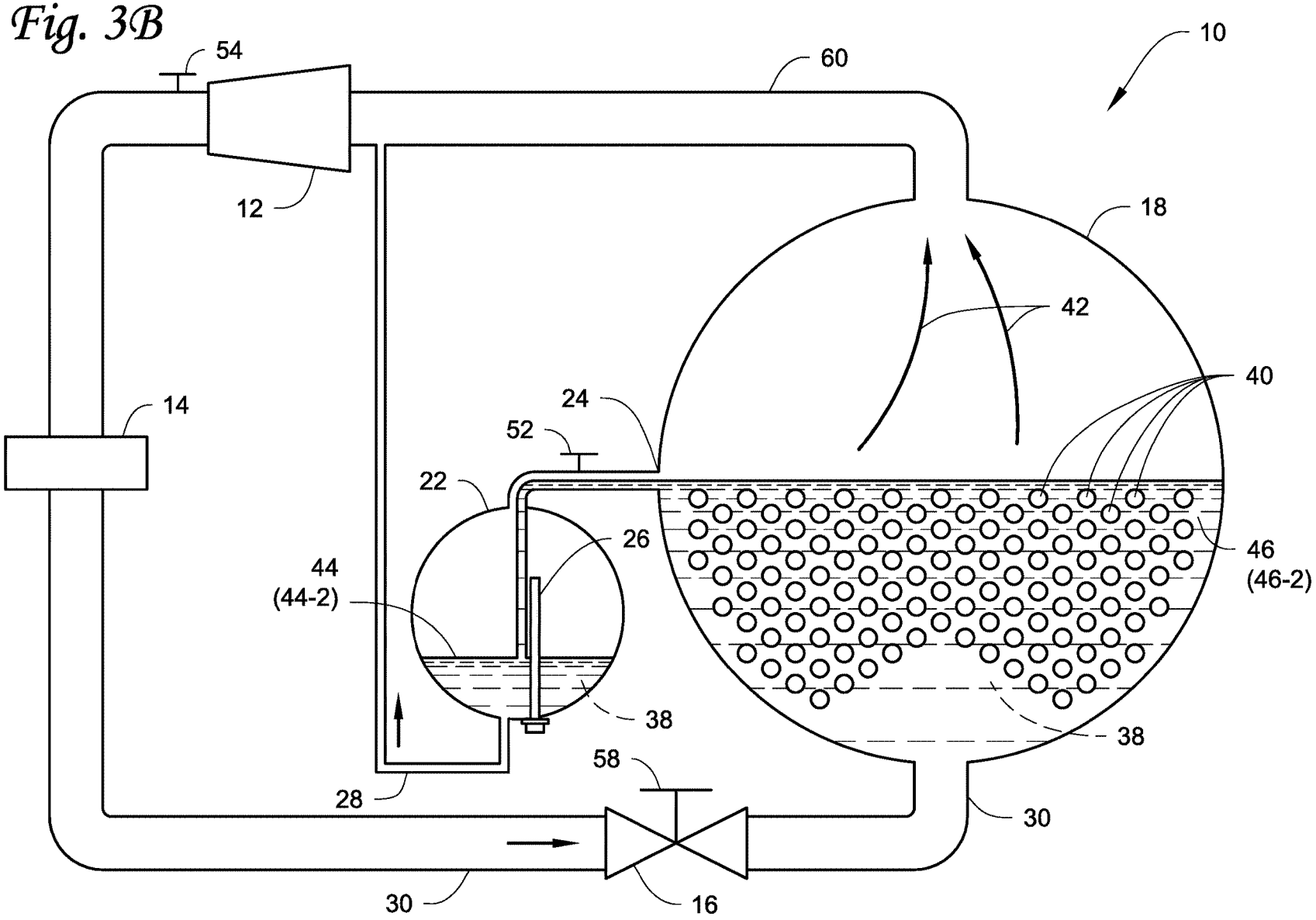
FIG. 3B illustrates the accumulator in the fluid compression system according to a second embodiment.

FIG. 3B illustrates the accumulator in the fluid compression system according to a second embodiment. FIG. 3B illustrates a partial load operating 46-2 condition associated with the evaporator 18.

A partial load operating condition 46-2 is an adequately charged evaporator 18. The partial load operating condition 46-2 is the amount of working fluid 38 that can enable the system 10 to properly function under operating conditions that are less than full load.

The partial load operating condition 46-2 can have a decreased void fraction in evaporator 18 compared to full load operating condition 46-1. A reduction in void fraction increases a charge density in the evaporator 18. The mass of working fluid may then be obtained from the accumulator 22. A change in the operating condition from the full load 46-1 to a partial load 46-2 decreases the void fraction (e.g. volume) of charge 38 in the evaporator 18. The decreased volume may decrease the charge level within the evaporator 18, which can cause a reduction in the charge spill-over rate. The decreased charge spill-over rate is a decrease of working fluid 38 spilling over into the accumulator 22, which can decrease a working fluid level 44 in the accumulator 22. The working fluid level 44 stored in the accumulator 22 decreases because the charge flow rate decreases from the evaporator 18 while working fluid 38 drains from the accumulator 22 into the first conduit 28. That is, the charge spill over rate is less than an amount of working fluid 38 flowing to the conduit 28. An increased charge level in the evaporator 18 can increase the charge spill-over rate until the charge spill-over rate matches the flow rate leaving the accumulator 22. The working fluid 38 stored in the accumulator 22 can aid in maintaining operation of the system 10.

A partial working fluid level 44-2 in the accumulator 22 can correlate to the partial load operating condition 46-2 associated with the evaporator 18. A decreased (e.g., low) amount of charge (e.g., working fluid 38) spill-over from the evaporator 18 into the accumulator 22 can decrease the working fluid level 44 (e.g., amount) stored in the accumulator 22. That is, the charge spill-over may not replace the amount of working fluid 38 flowing to the first conduit 28. The indicator 26 can detect (e.g., measure) the working fluid level 44. As such, a partial working fluid level 44-2 sensed by the indicator 26 in the accumulator 22 can indicate the partial load operating condition 46-2 of the evaporator 18.

The working fluid 38 from the accumulator 22 can supplement the vapor 42 from the evaporator 18 for proper functioning of the system 10. The working fluid 38 can travel to the compressor 12, condenser 14, through the second conduit 30, and to the expansion device 16. The expansion valve 58 can be opened to allow the working fluid 38 to return to the evaporator 18. Depending on the amount of working fluid 38 returned, the operating condition 46 may or may not change in response.

In an embodiment, at certain partial working fluid levels (e.g., 44-2), the level at partial load can indicate the lowest level at which the system 10 may function. The tube bundle 40 can be covered by working fluid 38, the compressor 12 can have adequate lubrication, the condenser 14 can hold sufficient working fluid, etc. In other words, the partial working fluid level 44-2 can indicate the minimum amount of charge required by the system 10 to properly function. In an embodiment, the partial working fluid level 44-2 can be a threshold level. When the working fluid level 44 in the accumulator 22 is at or below a threshold level (e.g., the minimum amount of working fluid 38 in the system 10 for proper operation), the evaporator 18 can initiate a shut-down operating condition to prevent damage to the system 10, as discussed further with respect to FIGS. 4 and 5.

It may be noted that in some examples, the variation in charge between a full load operating condition 46-1 and a partial load operating condition 46-2 associated with an evaporator 18 can be approximately less than ten pounds.

Figure 4:
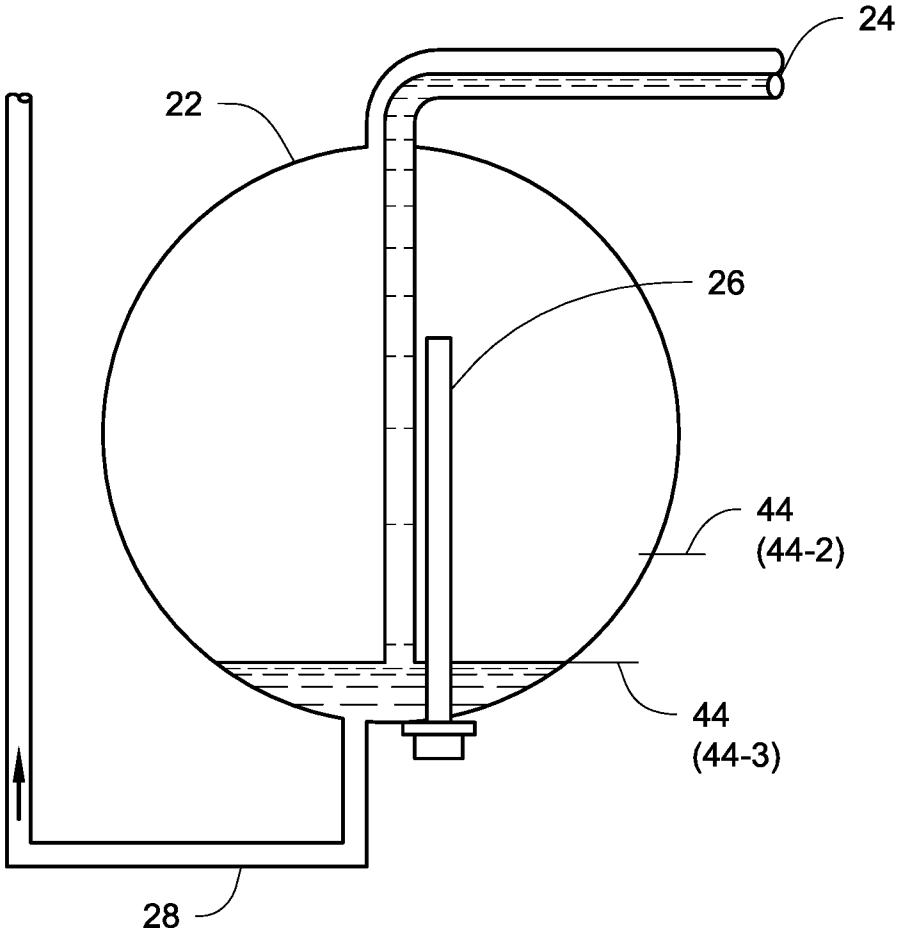
FIG. 4 illustrates the accumulator in the fluid compression system, according to a third embodiment.

FIG. 4 illustrates the accumulator in the fluid compression system according to a third embodiment. FIG. 4 illustrates a working fluid loss level 44-3 that indicates working fluid loss (e.g., a charge loss operating condition) associated with the evaporator.

When the working fluid level 44 in the accumulator 22 is below the partial working fluid level 44-2 (e.g., the threshold level), a working fluid loss level 44-3 can be detected by the indicator 26. A working fluid loss level 44-3 in an accumulator 22 can indicate an inadequately charged evaporator (e.g., 18 in FIGS. 3A and 3B). That is, an evaporator may have experienced loss of working fluid (e.g., 38 in FIGS. 3A and 3B) and/or may have a working fluid 38 imbalance in the evaporator, leading to a working fluid loss level 44-3 in the accumulator 22.

The working fluid/charge loss may be an indication of a leak in the system (e.g., fluid compression system 10 in FIGS. 3A and 3B).

The loss of working fluid in the evaporator may substantially decrease the working fluid level 44 in the accumulator 22. As working fluid 38 drains from the accumulator 22 to the first conduit 28, the amount of charge is not replaced via spill-over, which creates a deficit. That is, the loss of charge can decrease an amount of working fluid spilling over into the accumulator 22, thereby decreasing the amount of working fluid 38 stored in the accumulator 22.

In some embodiments, the charge spill-over rate may cease completely. The evaporator 18 may be unable to supply working fluid (e.g., 38 in FIGS. 3A and 3B) to the accumulator 22 due to increased vaporization of working fluid in the evaporator and/or not enough working fluid. That is, if the charge loss in the system is severe, the evaporator may not have charge (e.g., working fluid 38) reaching the spill over port 24, and thus charge spill-over may not be possible until working fluid 38 returns to the evaporator 18. If the charge loss is such that there is a lack of charge spill-over from the evaporator to the accumulator 22, lubricant may accumulate in the evaporator, which can cause foaming and high energy consumption until an adequate charge spill-over rate is reestablished.

A substantially decreased (e.g., low, completely cease flow, etc.) amount of charge spill-over from the evaporator into the accumulator 22 can substantially decrease the working fluid level 44 (e.g., amount) stored in the accumulator 22. The indicator 26 may detect the decreasing amount, which can indicate charge loss in the evaporator 18. As such, a working fluid loss level 44-3 relative to the accumulator 22 can indicate lack of working fluid associated with the evaporator, which may lead to a shut-down operating condition (e.g., 46-3), discussed further with respect to FIG. 5.

In some embodiments, the indicator 26 can detect the working fluid loss level 44-3. The working fluid loss level 44-3 can be an amount of working fluid 38 that is below a partial working fluid level 44-2 (e.g., threshold level), while the charge loss in the evaporator may indicate increased lubricant (e.g., in FIGS. 3A and 3B) accumulation in the evaporator (e.g., 18 in FIGS. 3A and 3B). The working fluid loss level 44-3 in the accumulator 22 can indicate a charge loss in the evaporator. Charge loss in an evaporator 18 is when inadequate levels of charge (e.g., working fluid 38) and/or an accumulation of lubricant is present within the evaporator 18, which prevents proper functioning (e.g., lubrication, cooling, etc.) of the fluid compression system 10.

The loss of working fluid/charge can pose danger to the system 10 if operation continues. In an embodiment, the working fluid loss level 44-3 in the evaporator 18 is detected by the indicator 26, which can trigger an alarm and/or initiate a shut-down operating condition 46-3. For instance, as illustrated in FIG. 4, a working fluid level 44 at or below the working fluid loss level 44-3 may initiate a shut-down operating condition to prevent damage to the system, as discussed further herein with respect to FIG. 5.

Figure 5:
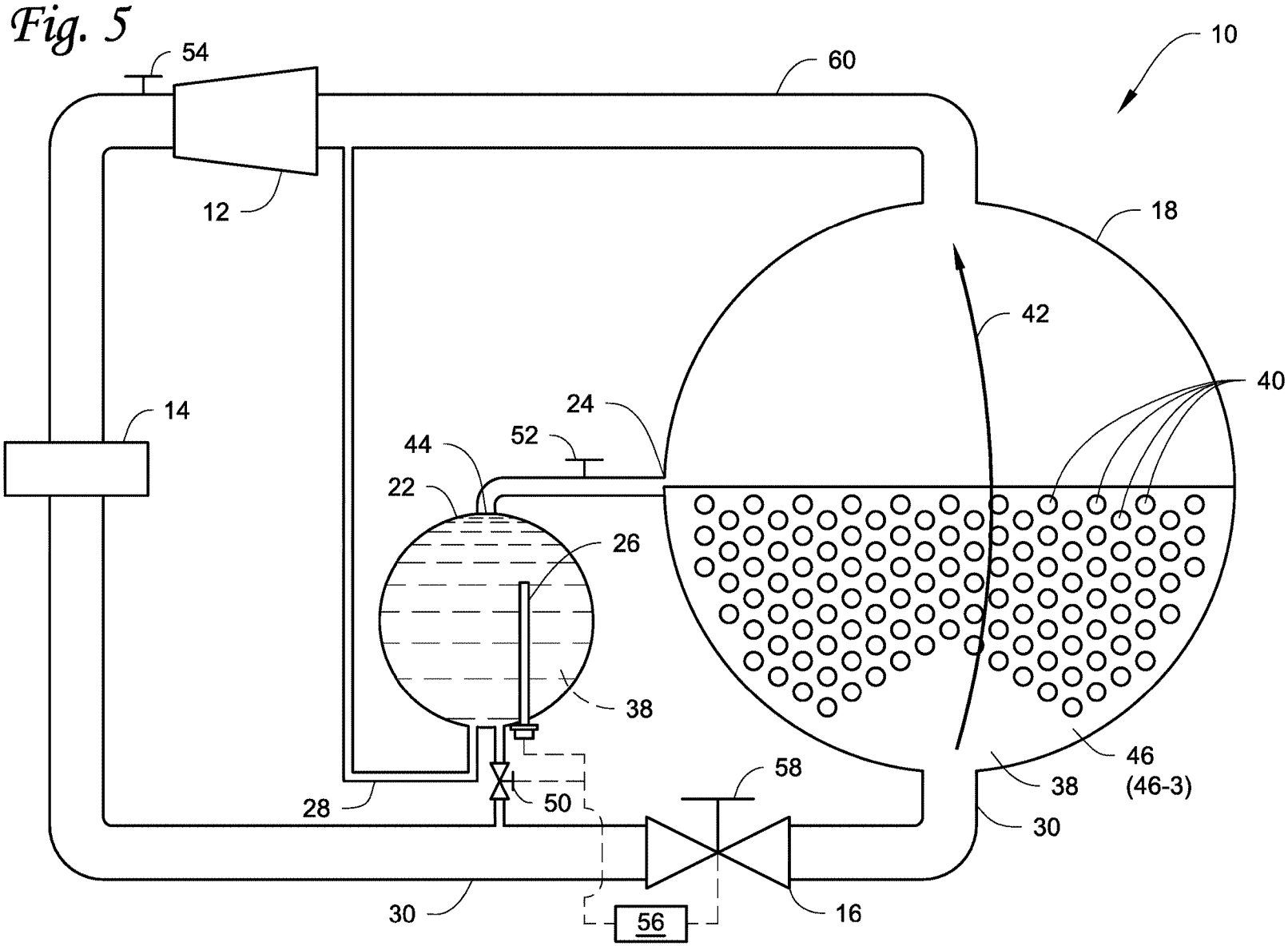
FIG. 5 illustrates the accumulator in the fluid compression system according to a fourth embodiment.

FIG. 5 illustrates an embodiment of the accumulator 22 in the fluid compression system 10, according to a fourth embodiment. FIG. 5 illustrates a shut-down operating condition 46-3 associated with the evaporator 18.

As illustrated in FIG. 5, the accumulator 22 is disposed on the outside of the evaporator 18. Although illustrated external to the evaporator 18, it will be appreciated that the accumulator 22 may be located in various locations of the evaporator 18. For example, the accumulator 22 can be disposed on any of the sides of the evaporator 18, and internal or external to the evaporator 18 in the fluid compression system 10.

In the fluid compression system 10, such as a chiller unit as part of an HVACR system, it may be desired to initiate a shut-down operating condition 46-3 to remove the charge (e.g., working fluid 38) from the evaporator 18. A shut-down operating condition 46-3 can be used to remove all of, or a significant portion of the charge 38 from the evaporator 18 to permit re-charging of the evaporator 18, prevent possible freezing or damage to the tube bundle 40, and/or maintenance purposes. In other words, the shut-down operating condition 46-3 can cause the charge to move from the evaporator 18 to the accumulator 22. The charge is diverted from the evaporator 18 by closing the expansion valve 58 of the expansion device 16 and opening the fill and drain valve 50, which allows high pressure refrigerant to flow from the condenser 14 into the accumulator 22. The working fluid 38 is primarily stored as a liquid. A portion of the diverted refrigerant can flash to vapor 42. The vapor 42 can flow through line 24 to the evaporator 18 to be removed by the compressor 12. The working fluid 38 can be stored for a period of time in the accumulator 22. Since the expansion valve 58 is closed (e.g., sealed) and the fill and drain valve 50 is open (e.g., unsealed), the working fluid 38 is stored as liquid in the accumulator 22.

In an embodiment, when the indicator 26 detects a working fluid 38 below a partial working fluid level 44-2 or at a working fluid loss level 44-3 in the accumulator 22, the indicator 26 can send a signal to a controller 56 associated with the system 10. The indicator 26 can send a working fluid level measurement (e.g., detection) to the controller 56. As illustrated in FIG. 5, the controller 56 is connected to the expansion device 16, the indicator 26, and the fill and drain valve 50 of accumulator 22 via dashed lines to indicate an electrical connection. The controller 56 is configured to receive the working fluid level 44 measured by the indicator 26. The controller 56 is further configured to control the fill and drain valve 50 and the expansion device 16 according to signals (e.g., inputs) from the indicator 26.

The controller 56 can initiate a shut-down operating condition 46-3 in response to the detected working fluid loss level 44-3 to permit maintenance and/or prevent damage to the system 10. The working fluid loss level 44-3 can correspond to the shut-down operating condition 46-3 of the evaporator 18. By initiating a shut-down operating condition 46-3 upon the detection of a working fluid loss level 44-3 (e.g., threshold level), the system 10 can avoid damage. That is, a shut-down operating condition 46-3 may be used for maintenance purposes and/or prevention of freezing, tube bundle 40 damage, and/or damage to the system 10.

The shut-down operating condition 46-3 can initiate the fluid compression system 10 to remove all of, or a significant portion of the charge from the evaporator 18. The working fluid 38 can be stored in the accumulator 22. For example, the portion of charge (e.g., working fluid 38) that had been in the evaporator 18 can be moved, via boiling, to the accumulator 22 for storage for a period of time.

To restart the fluid compression system, as illustrated in FIG. 5, a fill and drain valve 50 can be connected to the accumulator 22 in an embodiment. The fill and drain valve 50 can be used to drain the stored working fluid 38 (e.g., working fluid level 44) into the evaporator 18 until the charge in the evaporator 18 meets the spillover port 24 and establishes charge balance in the fluid compression system 10. Balance is restored when a charge (e.g., working fluid 38) spill-over rate is reestablished in the fluid compression system 10, such that the evaporator 18 is operating at or above a partial load operating condition 46-2. That is, the accumulator 22 at least has a partial working fluid level 44-2 and the evaporator 18 is operating at a partial load operating condition 46-2 or at a full load operating condition 46-1.

The controller 56 can be configured to open or close the fill and drain valve 50 and/or the expansion device 16 so as to regulate the working fluid 38 flowing to the evaporator 18. Regulating the working fluid flow to the evaporator 18 can result in changes to the amount of working fluid 38 in the evaporator 18, condenser 14, as well as the amount of working fluid 38 in the accumulator 22. As such, the controller 56 can regulate a distribution of working fluid 38 through the fluid compression system 10.

In an embodiment, a start-up operating condition can be associated with the evaporator 18. The start-up operating condition can correspond to a start-up working fluid level in the accumulator 22. That is, the start-up operating condition relevant to the evaporator 18 can drain the stored working fluid 38 from the accumulator 22 to the evaporator 18 to establish balance in the system 10. For example, the working fluid level 44 in the accumulator 22 may be fluctuating between a high working fluid level (e.g., 44-1) and a partial working fluid level (e.g., 44-2) depending upon the amount of working fluid 38 drained from the accumulator 22 via the fill and drain valve 50 to the evaporator 18.

In an embodiment, the evaporator 18 can include one or more flow control devices 52 located for example between the evaporator 18 and the spill over port 24. In an embodiment, the flow control device 52 is a valve which can be automatically and/or actively controlled by the controller 56 of a unit (e.g., fluid compression system 10) or a system controller, which controls multiple units and/or devices (e.g. in a building). The flow control device 52 can control working fluid 38 flow from the evaporator 18 into the accumulator 22. It will be appreciated that the flow control device 52 can be any suitable valve whether controlled or manually operated. For example, the flow control device 52 can be opened or closed to control the flow of working fluid 38 from the evaporator 18 to the accumulator 22. In some circumstances, the flow control device 52 is a manually operated valve, for example in a system which uses maintenance pump down and not operational pump down.

A goal of the shut-down operating condition 46-3 is to empty an amount of charge 38 from the evaporator 18. For example, the evaporator 18 may be emptied in preparation for a re-charging of the system 10. It will be appreciated that shut-down operating condition 46-3 can also be done for maintenance or service, such as when the indicator 26 detects a working fluid loss level 44-3 and/or to properly charge the fluid compression system 10.

Generally, the amount of charge to be removed from the evaporator 18 can vary depending on the fluid compression system 10 design. Generally, at least a sufficient amount of charge (e.g., working fluid 38) is removed so as not to be susceptible to freezing or to a level of freezing which may be harmful and/or undesired. The accumulator 22 can be sized and located appropriately to meet the system design, and may include more than one accumulator 22. For example, in some embodiments, a plurality of accumulators (e.g. multiple 22*s*) may be fluidly connected to the evaporator 18 via a plurality of charge spill-over ports (e.g., multiple 24*s*). The evaporator 18 can provide charge to the plurality of accumulators to store additional working fluid. In some instances, the plurality of accumulators may store different volumes of working fluid depending on the location of the respective charge spill-over port connected to the evaporator 18.

In some embodiments, the accumulator 22 can effectively increase the volume of the condenser 14, and as such, the accumulator 22 may remove the need for storage of working fluid 38 in the condenser 14 (e.g. when using a microchannel heat exchanger for the condenser 14). Additionally, and/or alternatively, because the working fluid does not contact evaporator 18 tubes, an isolation valve may not be required.

By adding the fill and drain valve 50 to the accumulator 22, the accumulator 22 can be used to store (e.g., fill) the working fluid 38 upon a shut-down operating condition 46-3 of the evaporator 18 and restore (e.g., drain) working fluid 38 from the accumulator 22 to restore charge to the evaporator 18 after the shut-down operating condition 46-3 (e.g., for startup). For example, the evaporator 18 can boil/vaporize 42 the working fluid 38, which can flow through a third conduit 60, to the compressor 12, and through the condenser 14. The fill and drain valve 50 can be opened so that the accumulator 22 can store the working fluid 38 flowing through the condenser 14, while the expansion device 16 can be closed to isolate the vaporization 42 of the remaining working fluid 38 in the evaporator 18. In an embodiment, the remaining working fluid 38 in the evaporator 18 is collected in the accumulator 22 during a shut-down operating condition 46-3.

By closing the expansion valve 58 and opening the fill and drain valve 50, the accumulator 22 becomes part of the condenser 14 circuit. The compressor 12 can be used to boil the charge (e.g., working fluid 38, refrigerant, mixture, etc.) out of the evaporator 18. In some embodiments, a check valve 54 can be located for example between the condenser and the compressor 12 to prevent backwards flow from the condenser 14. The check valve 54 prevents working fluid from flowing back into the compressor 12, thereby preventing damage to the compressor 12. The expansion device 16 may shut off (e.g., close) with a leak tight seal. Closing the fill and drain valve 50 can complete isolation of the circuit.

Upon a restart operating condition, the expansion valve 58 can be opened while the fill and drain valve 50 remains open to refill the evaporator 18 and enable the system 10 to operate at a full-load operating condition (e.g., 46-1) or a partial load operating condition (e.g., 46-2). The working fluid 38 stored in the accumulator 22 can be drained to the second conduit 30 and through the expansion device 16 to be provided to the evaporator 18. The working fluid 38 can travel through the expansion device 16 and to the evaporator 18 where the working fluid 38 can be provided to the accumulator 22 via the spill-over port 24.

Additionally, or alternatively, in some embodiments, sub-cooling control can keep a mass of charge 38 in the condenser 14 fixed. The sub-cooling can help to maintain a mass flow balance between the compressor 12 and the expansion device 16. The sub-cooling can minimize charge variation in the condenser 14 so it may operate at peak efficiency. The working fluid 38 (e.g., refrigerant) draining from the accumulator 22 into the first conduit 28 can eventually collect in the evaporator 18 until charge spills over via the spill over port 24 and balance is reestablished in the fluid compression system 10.

Additionally, or alternatively, in some embodiments, the indicator 26 can detect a transition operating condition associated with the evaporator 18. For example, the indicator 26 may detect a working fluid level 44 in the accumulator 22 that fluctuates between a working fluid loss level 44-3 and a partial working fluid level 44-2. When the fill and drain valve 50 is closed, the accumulator 22 can store the working fluid 38 that spills over from the evaporator 18. In response to the operating condition 46 relative to the evaporator 18, the working fluid level 44 can fluctuate. The fluctuation between the two different working fluid levels 44 can indicate a transition operating condition associated with the evaporator 18. The working fluid level 44 in the accumulator 22 indicates the evaporator 18 is operating a partial load operating condition 46-2 for a period of time, and operating with working fluid loss for a different period of time. The working fluid level 44 in the accumulator can fluctuate without triggering a shut-down operating condition 46-3 in the evaporator 18 for a predetermined period of time.

The indicator 26 can send a signal indicating the working fluid loss level 44-3 to the controller 56. The controller 56 may not initiate a shut-down operating condition 46-3 until the working fluid loss level 44-3 has been indicated by the indicator 26 for a predetermined period of time to account for the transition operating condition. That is, there may be a period of time at which the indicator 26 measures a working fluid loss level 44-3 in the accumulator 22 before achieving a partial working fluid level 44-2. Provided the working fluid loss level 44-3 does not exceed the predetermined period of time, the system 10 may not enter a shut-down sequence via the controller 56 since the predetermined time period can be construed as a transient or a false positive condition. In other words, the controller 56 of the fluid compression system 10 may not initiate a shut-down operating condition 46-3 upon detection of a working fluid loss level 44-3 unless the working fluid loss level 44-3 is detected for a predetermined period of time to account for transition operating conditions. Accounting for the transition operating conditions can prevent an unnecessary shut-down operating condition 46-3.

It will be appreciated that as long as there is working fluid 38 in the accumulator 22, there will be lubricant return to the evaporator 18 within the heating exchanger system 10, such that the system 10 can continue to properly function via the various operating conditions 46.

It is to be appreciated that the embodiments and principles described herein may be adapted to use with any other fluid containing apparatus.

With regard to the foregoing description, it is to be understood that changes may be made in detail, without departing from the scope of the present invention. It is intended that the specification and depicted embodiments are to be considered exemplary only, with a true scope and spirit of the invention being indicated by the broad meaning of the claims.

The invention claimed is:

1. A fluid compression system, comprising:

a compressor;

a condenser, an expansion device, and an evaporator fluidly connected to the compressor;

an accumulator fluidly connected to the evaporator via a spillover port, the spillover port directs working fluid received from the evaporator to be collected and stored in the accumulator;

a first conduit fluidly connected to the accumulator and the compressor, the first conduit configured to direct lubricant from the accumulator to the compressor;

a fill and drain valve fluidly connected to the accumulator; and a second conduit fluidly connected to the accumulator and at a location disposed fluidly between an outlet of the condenser and an inlet of the expansion device, the fill and drain valve disposed in the second conduit, the fill and drain valve configured to release working fluid stored in the accumulator to the second conduit, wherein actuation of the fill and drain valve is in response to a start-up operating condition relative to the evaporator, wherein the working fluid is stored and released from the accumulator in response to an operating condition of the evaporator.

2. The system of claim 1, wherein the operating condition is among a plurality of operating conditions, and each operating condition among the plurality of operating conditions is relative to the evaporator and corresponds to a working fluid level in the accumulator.

3. The system of claim 2, wherein the plurality of operating conditions include:

a full load operating condition that corresponds to a full load working fluid level in the accumulator;

a partial load operating condition that corresponds to a partial working fluid level in the accumulator;

a shut-down operating condition that corresponds to a working fluid loss level in the accumulator; and a start-up operating condition that corresponds to a start-up working fluid level in the accumulator.

4. The system of claim 1, further comprising an indicator, the indicator configured to:

detect a working fluid level in the accumulator, wherein the detected working fluid level in the accumulator corresponds to an amount of charge and particular operating condition associated with the evaporator; and identify, via the detected level of working fluid the accumulator, a partial load operating condition at which the fluid compression system operates.

5. The system of claim 1, further comprising a controller to initiate a shut-down operating condition when an indicator detects a working fluid loss level stored in the accumulator for a predetermined period of time.

6. The system of claim 1, further comprising an indicator located at least partially within the accumulator, wherein the indicator is configured to:

detect a working fluid level in the accumulator, the working fluid level corresponds to a stored charge amount and the operating condition relevant to the evaporator; and provide an indication to a controller of the fluid compression system of a detected working fluid loss level that corresponds to a charge loss operating condition relative to the evaporator.

7. The system of claim 1, wherein the operating condition of the evaporator is a transition operating condition, and the transition operating condition corresponds to a transition working fluid level of the accumulator, and wherein the transition operating condition does not initiate a shut-down operating condition.

8. The system of claim 7, wherein the transition operating condition indicates a partial working fluid level in the evaporator for a predetermined time to prevent a false charge loss indication.

9. The system of claim 1, wherein the accumulator is external to the evaporator, and a working fluid spill-over rate from the evaporator to the accumulator is directly correlated.

10. A cooling system, comprising:

a compressor;

a condenser fluidly connected to the compressor;

an evaporator fluidly connected to the compressor;

an expansion device fluidly connected to the evaporator and the condenser;

an accumulator fluidly connected to the evaporator;

a fill and drain valve fluidly connected to the accumulator, the fill and drain valve arranged to release working fluid stored in the accumulator to pass from the accumulator to the expansion device and evaporator based on an operating condition of the evaporator;

a first conduit fluidly connected to the accumulator and the compressor, the first conduit configured to direct lubricant from the accumulator to the compressor;

a second conduit fluidly connected to the accumulator and at a location between an outlet of the condenser and an inlet of the expansion device, the fill and drain valve disposed in the second conduit.

11. The cooling system of claim 10, wherein working fluid is released from the accumulator via the fill and drain valve in response to a start-up operating condition relative to the evaporator.

12. The cooling system of claim 10, wherein the fill and drain valve is opened and an expansion valve of the expansion device is closed in response to a shut-down operating condition to isolate a vaporization of the working fluid in the evaporator.

13. The cooling system of claim 12, wherein the fill and drain valve is opened and the expansion valve is opened in response to a start-up operating condition relative to the evaporator, wherein the accumulator provides stored working fluid to the evaporator.

14. The cooling system of claim 10, further comprising an indicator located at least partially within the accumulator, wherein the indicator is a level sensor.

15. The cooling system of claim 14, wherein the indicator detects a working fluid level within the accumulator, the working fluid level correlates to the operating condition of the evaporator.

16. The cooling system of claim 14, wherein the indicator is configured to provide an indication of a working fluid loss charge level to a controller that correlates to a shut-down operating condition in the evaporator.

17. A method of controlling a fluid compression system, comprising:

detecting, via an indicator, a working fluid level stored in an accumulator;

correlating the working fluid level to an operating condition among a plurality of operating conditions relative to an evaporator;

storing, in the accumulator, an amount of charge provided from the evaporator in response to the operating condition, wherein the working fluid level increases or decreases depending upon the operating condition; and actuating a fill and drain valve fluidly connected to the accumulator, the fill and drain valve fluidly disposed at a location between an outlet of a condenser and an inlet of an expansion device based on the operating condition of the evaporator.

18. The method of claim 17, further comprising initiating, via a controller, a shut-down operating condition relative to the evaporator in response to the working fluid level being less than a working fluid threshold level, wherein charge from the evaporator at least substantially fills the accumulator.

* * * * *